US005575321A

United States Patent [19]

Currier

[11] Patent Number: 5,575,321

[45] Date of Patent: Nov. 19, 1996

[54] SECURITY DOOR SYSTEM FOR SLIDING SCREEN DOORS

[76] Inventor: Ken E. Currier, 10 English Run Turn, Sparks, Md. 21152

[21] Appl. No.: 384,842

[22] Filed: Feb. 7, 1995

[51] Int. Cl.[6] ..... E06B 3/32

[52] U.S. Cl. ..... 160/90; 160/104; 52/207; 49/50; 49/501; 49/404; 292/DIG. 46; 70/97; 70/100

[58] Field of Search ..... 160/89, 90, 91, 160/101, 104, 368.1; 52/207; 49/50, 501, 404; 292/137, DIG. 46; 70/100, 97

[56] References Cited

U.S. PATENT DOCUMENTS

| | | | |
|---|---|---|---|
| 600,904 | 3/1898 | Beall . | |
| 1,587,658 | 6/1926 | Laycock . | |
| 1,902,949 | 3/1933 | Condon . | |
| 3,039,153 | 6/1962 | Dusing | 292/DIG. 46 X |
| 3,121,318 | 2/1964 | Norrenberg-Sudhaus | 292/137 X |
| 3,167,112 | 1/1965 | Tucker | 160/90 X |
| 3,283,804 | 11/1966 | Yancey | 160/368.1 X |
| 3,616,838 | 11/1971 | Barr | 160/90 |
| 3,871,434 | 3/1975 | Hance | 49/50 X |
| 3,895,669 | 7/1975 | Heeling | 160/92 |
| 4,061,370 | 12/1977 | Hauber | 292/DIG. 46 X |
| 4,103,945 | 8/1978 | Turman | 292/DIG. 46 X |
| 4,226,049 | 10/1980 | Maust | 49/57 |
| 4,314,719 | 2/1982 | Hawkins | 292/DIG. 46 X |
| 4,484,410 | 11/1984 | English | 49/63 |
| 4,592,167 | 6/1986 | Andrawos | 49/171 |
| 5,105,868 | 4/1992 | Riise | 160/90 |
| 5,152,561 | 10/1992 | Engebretson | 292/DIG. 46 X |
| 5,283,975 | 2/1994 | Piterski | 49/50 |

FOREIGN PATENT DOCUMENTS

| | | | |
|---|---|---|---|
| 8180314 | 10/1983 | Japan | 49/404 |
| 6117171 | 4/1994 | Japan | 160/104 |
| 30665 | 12/1897 | United Kingdom | 160/104 |
| 2208302 | 3/1989 | United Kingdom | 49/404 |

*Primary Examiner*—Blair Johnson
*Attorney, Agent, or Firm*—Leonard Bloom

[57] ABSTRACT

The invention is directed to a security grille system for attachment to screen sliding doors. Many safety features are encompassed in the design of the system.

18 Claims, 11 Drawing Sheets

SECURITY DOOR SYSTEM FOR SLIDING SCREEN DOORS

FIELD OF THE INVENTION

The present invention relates to security systems for sliding doors.

BACKGROUND OF THE INVENTION

Screens for doors and windows are a conventional installation in every home and have been in use for many years. Screens allow for natural ventilation from outdoors while keeping insects and animals out. Many different models of ventilation screens have been developed, ranging from the familiar sliding screen door to the permanent burglar-proof wrought iron bars often found adorning the outside of many residential screened windows.

Today, breaking and entering into residential and business premises is all too common. It is necessary to augment the conventional types of locks, which skilled burglars can easily circumvent. Additional security is especially needed in the case of horizontally sliding glass and screen doors or windows of the types employed in many modern homes and apartments. During warm weather, it is desirable to open such doors or windows for ventilation; and even if a screen door is interposed in the opening, it can be readily and quietly cut and opened.

Numerous security systems have been devised in accordance with the prior art, such as various types of grills, window guards, and screens; but none of them is suitable for use with sliding glass doors or windows which are opened to a variety of open positions. Moreover, these security systems are either too expensive or cumbersome to install, or they have locks which are readily identifiable from the outside and easily removed by a skilled burglar having simple tools.

There is an increasing concern with crime and personal safety. In the past, screens served the purpose of keeping intruders from entering premises. In our present-day society a simple screen door will not suffice to keep out the evil-bent intruder. The present invention addresses the problem presented by insecure sliding doors and is particularly concerned with security arrangements for sliding screen doors.

PRIOR ART

Prior art patents describe many types of screening arrangements and security devices for windows and doors. Examples of some of these patents follows:

Beall in U.S. Pat. No. 600,904 teaches a burglar-proof window or door screen. The door screen is on a hinged door and the protecting wires or grid are woven through openings in the frame, in a manner which prevents the wires or grid from being withdrawn from the frame.

U.S. Pat. No. 1,587,658 to Laycock teaches a casement window with a separately hinged panel or grillwork meant to simulate the effect of a French window. No sliding doors are disclosed in this patent; and furthermore no sliding screen door with a security screen integrally attached is described.

Condon in U.S. Pat. No. 1,902,949 teaches a combined window guard and screen which may be inserted and locked in a window frame. The window guard locks in the window frame but does not move with the window panel. The window panel can be moved while the window guard stays in place.

A weather shield for sliding doors is taught by Barr in U.S. Pat. No. 3,616,838. The weather shield is designed to be readily applied onto a sliding door, and is adapted for temporary use in inclement weather. The shield has a zipper access for entrance into the building rather than access through the movement of the shield attached to the sliding door.

A security door is taught in U.S. Pat. No. 3,895,669 to Heeling. In this patent the security system is for a hinged door rather than a sliding door. The security system is in the center of the door and does not lock into the frame of the door.

U.S. Pat. No. 4,226,049 to Maust teaches a security ventilating system for sliding windows and doors. The system shown by Maust is for lift-out metal grills constructed to fit between a partially opened door or window and the frame of the door or window. The security ventilating system of Maust is not attached to a screen sliding door in such a way as to move back and forth along with the screen sliding door.

An interior security door panel is taught by English in U.S. Pat. 4,484,410. The patent describes the security door panel as sliding independently on a track. The English security door panel slides on an independent track and does not slide attached to a screen sliding door.

U.S. Pat. No. 4,592,167 to Andrawos teaches a security sliding panel (screen) to be fitted onto an aperture of a solid hinged door. The sliding panel or screen slides on a track attached to the door. The security sliding panel is not attached to a sliding screen panel.

Riise in U.S. Pat. No. 5,105,868 teaches a sliding door security screen that can be quickly inserted comprising a rigid screen to be slid into the top and bottom track of a sliding door arrangement. The security screen may provide for a lock and a means for securing the screen to the sliding door. The Riise device is a lift-out screen insert and there are no provisions for attaching the screen to a sliding screen door, so that the grille slides along with the sliding door. The Riise device simply bridges the opening between the sliding door and the jamb.

None of the prior art patents cited shows a sliding screen door security system which can be installed as a unit onto the surface of an existing sliding screen door, and none of the patents describes the unique security arrangement for use with the sliding screen door security system.

Objects of the Invention

A primary object of this invention is to produce a security grille for a sliding screen door which is easy to install as an add-on or retrofit to an existing sliding screen door.

A further object is to produce a security grille which is aesthetically pleasing.

A still further object is to produce a device which will allow a sliding screen door to be partially or fully open while still maintaining the security of the interior.

A primary object of this invention is to produce a security sliding door system in which the sliding door is not easily lifted off of its track and removed by a burglar.

SUMMARY OF THE INVENTION

With all of this in mind the inventor has invented a security system employing security grilles which attach directly to the frame of an existing sliding screen door and stationary glass panel. With the security grilles attached; and with the auxiliary lock secured, the glass sliding door can be opened allowing for room ventilation without the need for running an air-conditioner. Access to unwanted intrusion, especially at night when occupants are asleep is blocked, and the inhabitants of the house can feel secure. As a further feature, the degree of ventilation can be controlled by the amount the sliding glass door is opened.

The grilles are easy to install because all that is needed is to screw or bolt the security grilles to existing structures. About forty-five (45) minutes to one hour is all that is needed for installation. Because of this ease of installation, the security grilles of this invention will be a boon to after-market use.

The grilles have an aesthetically pleasing appearance. Moreover, the installed security grilles will not interfere with the operation of curtains, blinds or drapes. A particular advantage of the sliding door arrangement as opposed to a hinged door is the fact that valuable patio space or deck space will not be lost. This is so because a hinged door when it opens, swings over patio or deck space, thus precluding the use of that space for other than the opening or the closing of the door.

The security system of this invention has several features which will provide added protection against the unauthorized removal or opening of the sliding screen door. To prevent the screen door from being lifted out of its track, the inventor has added a raised threshold which blocks track clearance preventing the removal of the sliding screen door from its sliding track. The sliding screen door will have a special lock to prevent the screen door from being slid open or lifted off of its track. Additional side brackets are installed to prevent the screen door from being lifted off of its track. Retractable pins can be installed in the sliding door to fix the position of a partially opened door. Additionally, pins can be inserted into the track to prevent the screen door from being opened beyond a point of security. The sliding glass door, as well as the sliding screen door, each can be provided with special locks which will afford an added measure of safety.

A most important feature of this invention is a sliding screen door security kit comprising a security grille for mounting on a sliding screen door, a key operated locking unit, a sliding flat bolt locking unit and the mounting hardware therefor. The kit can further comprise a grille for a stationary glass panel and the mounting hardware therefor, as well as a raised security threshold and mounting hardware therefor.

The disclosed invention involves a sliding door security system to be used in a building in combination with a sliding screen door and a sliding glass door comprising a sliding screen door and a sliding glass door. Each door sliding in an upper track and a lower threshold track. The sliding screen door having a rear surface and a front surface, as well as a rear frame border and front frame border both of which are around the perimeter of the sliding screen door. The rear surface of the sliding screen door faces the sliding glass door. Said front frame border around the perimeter of said sliding screen door being provided with a surface-mounted and attached security grille; and wherein the mounted and attached security grille slides along with the sliding screen door, provides security to the interior of a building, as well as allowing air to readily circulate to the interior of the building to which the sliding screen door is attached.

The security system for the sliding screen door may also be provided with a raised threshold blocking member parallel to the lower threshold track in which the sliding screen door slides. This threshold blocks the ability to readily remove the sliding screen door. Further, the security system includes a key-operated lock affixed to said rear frame border to secure the sliding screen door and attached grille into a locked position. Said lock is an integral unit and is capable of being placed at any location along the door jamb and rear frame border. In a preferred embodiment, the grille is of a French or Colonial design. As an option the security system may provide for a second sliding door, with an upper and lower track positioned between the first sliding door and sliding screen door.

The security system for the sliding door should include a stationary glass panel in a frame juxtaposed between the sliding screen door and sliding glass door. There is a flat bolt arrangement attached to the frame of the sliding screen door and the frame of the stationary glass panel. The flat bolt arrangement and key-operated lock both engaged will preclude the sliding screen door from being lifted out of its track and removed.

The security system further encompasses a building having a sliding door structure for a patio or balcony, wherein the structure includes a frame, a stationary glass panel, a sliding glass door, and a sliding screen door, respectively. There is an improvement in the building structure comprising a security grille attached to the sliding screen door and sliding therewith; and a key-operated lock between the sliding screen door and the frame and with the lock being accessible internally of the building. The security of this system being such that even if the sliding screen door with its security grille attached thereto is penetrated by an intruder, the lock cannot be unlocked by the intruder to open the sliding screen door. Further, the sliding glass door may be opened at any desired distance from the frame, thereby adjusting the degree of desired ventilation while assuring security for the occupants of the building. In addition, there may be a matching security grille secured to the stationary glass panel. The grilles may have a French Door design, thereby providing an aesthetically pleasing appearance as well as enhanced security.

The security system may have along with the security grille attached to the sliding screen door and sliding therewith, a key-operated lock between the sliding screen door and the frame and accessible internally of the building. In addition, attached to the stationary glass panel and the sliding screen door are a stationary horizontal flat bolt and keeper, such that when the sliding screen door is closed, the stationary horizontal flat bolt will lock into its keeper, and along with the key-operated lock fastened, the sliding screen door can not be lifted out of its track. In the security arrangement, the key-operated lock has a bolt moving in a vertical orientation to be received in a keeper placed above the key-operated lock.

In one of its most preferred embodiments, the security system provides for a security grille attached to the inside surface of the stationary glass panel. A second security grille attached to the outside of the sliding screen door and sliding therewith. A key-operated lock between the sliding screen door and the frame and accessible internally of the building. Attached to the stationary glass panel and the sliding screen door are a stationary horizontal bolt and keeper. Once the sliding screen door is closed, the stationary horizontal bolt will lock into its keeper, and along with the key-operated lock fastened, the sliding screen door can not be lifted out of its track. The security arrangement is of great advantage because even if the sliding screen door with its security grille attached are penetrated by an intruder, the lock cannot be unlocked by the intruder to open the sliding screen door.

GENERAL DESCRIPTION OF THE PREFERRED EMBODIMENTS

Figure 1:
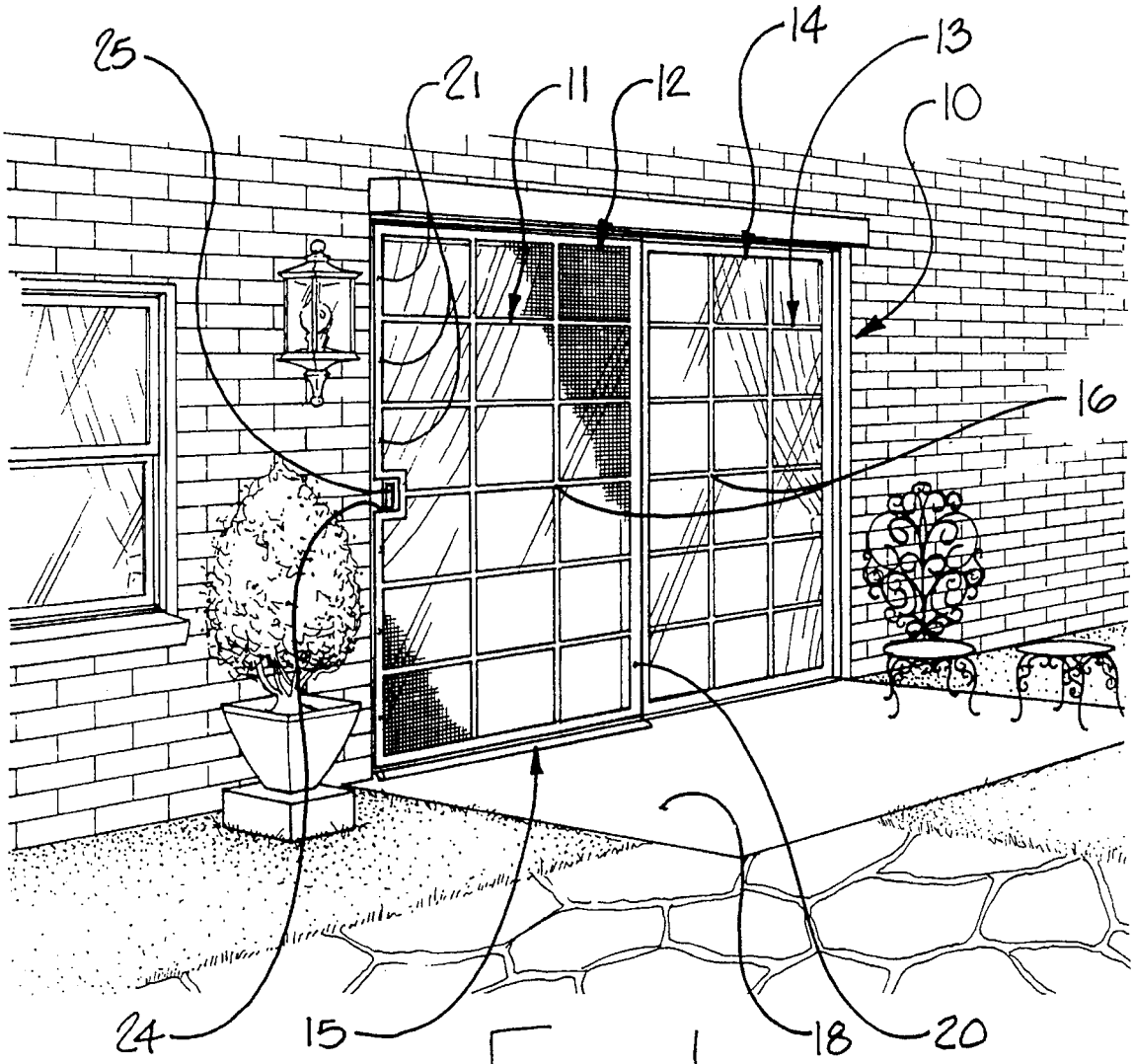
FIG. 1 is a pictorial view of the double door security system of this invention.
Figure 10:
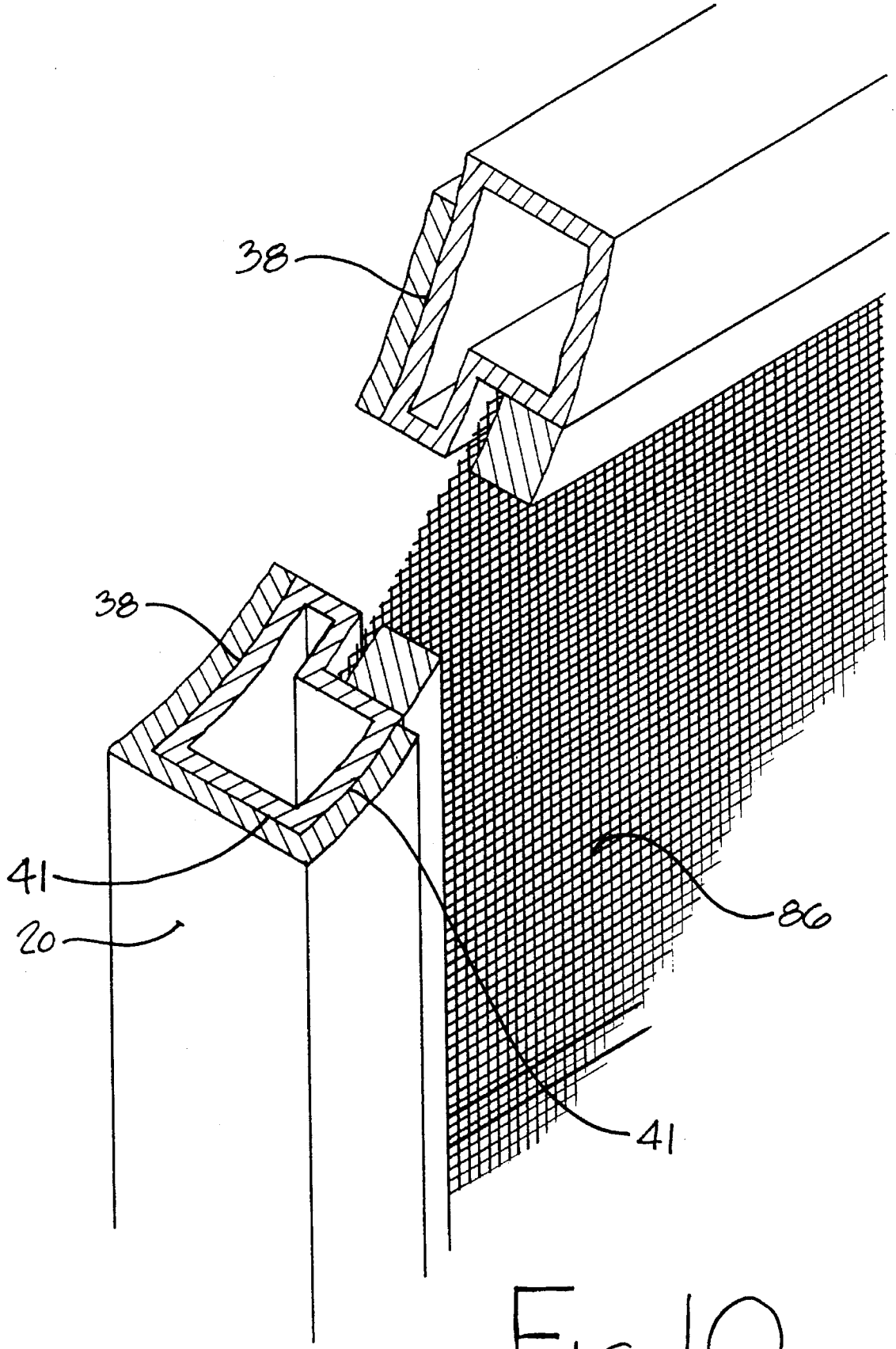
FIG. 10 is a greatly enlarged perspective cross-sectional view showing a grille with a jay-channel affixed to the sliding screen door. Part of the upper corner portion of the screen and grille have been broken away to show how the jay-channel surrounds the door.

With reference to FIG. 1, the security system 10 of this invention is illustrated. A security grille 11 is surface mounted on a sliding screen door 12. The security grille 11 is mounted on the outside surface of the screen door 12. A second security grille 13 is mounted on the inside surface of the stationary glass panel 14 opposite the sliding screen door 12. The sliding screen door grille 11 of FIG. 1 is one mounted using a jay-channel 20 and has safety bolts 21 (head only shown) only along the left side of the door. The grille 11 with the jay-channel 20 is shown in greater detail in FIGS. 7, 10, and 11.

The security system 10 has an installed raised threshold 15 to block unauthorized access to the bottom of the screen door 12. (Shown in greater detail in FIGS. 5 and 11.) This raised threshold 15 serves to secure the sliding screen door 12 in its track (shown in FIG. 5) since with the raised threshold 15 in its place the sliding screen door 12 cannot be lifted out of its track.

The French Door look of grilles 11 and 13, with grids 16, as opposed to a bar arrangement, is aesthetically pleasing. The sliding door security system 10 when installed will not interfere with hung curtains 17 or blinds. The sliding screen surface mounted grille 11, in contrast to a hinged door and grille resorted to in the prior art will not use up patio space 18 when the screen door 12 is slid open or closed.

Figure 2:
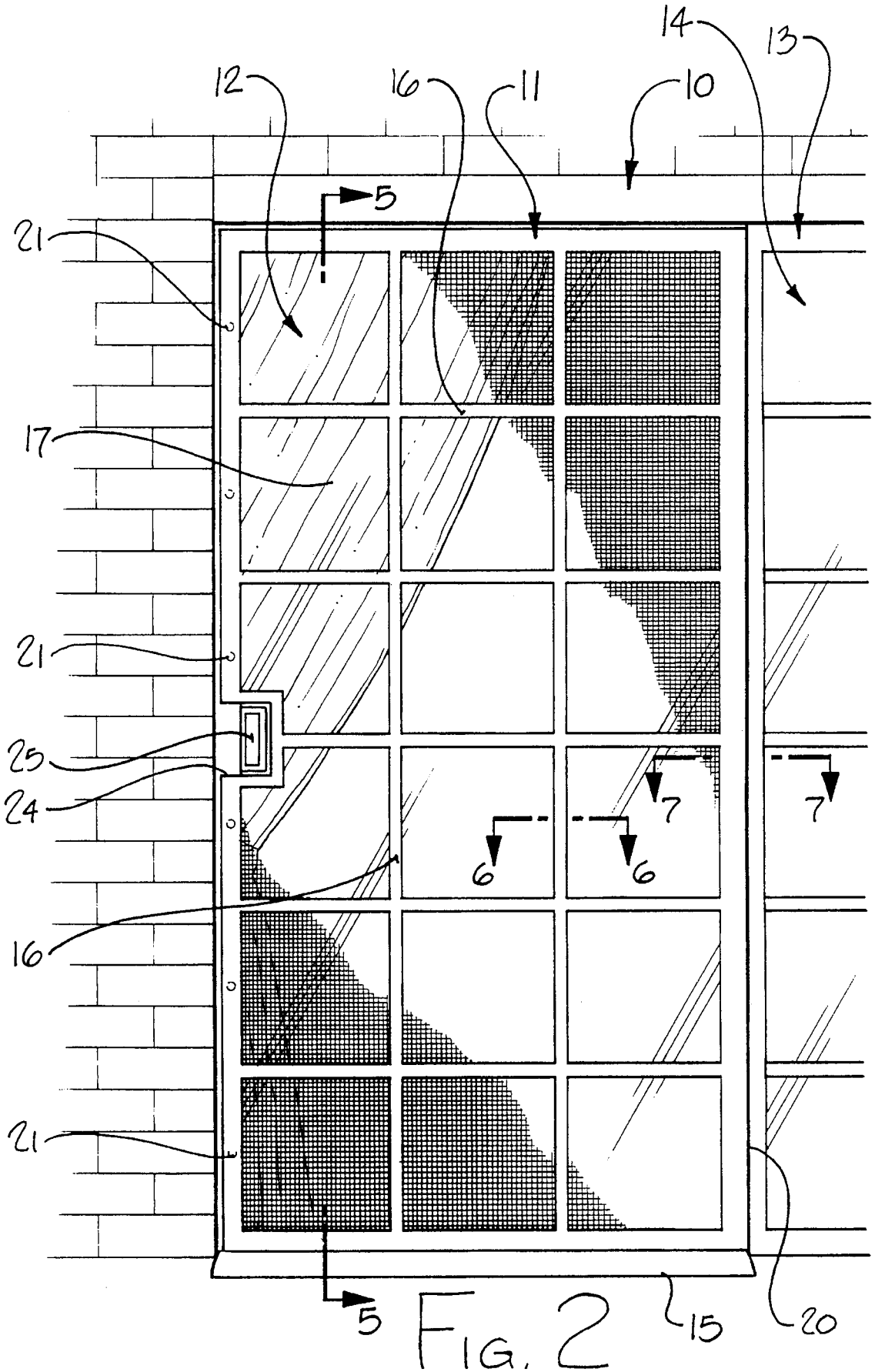
FIG. 2 is an enlarged front elevational view of the sliding screen door and security grille.
Figure 3:
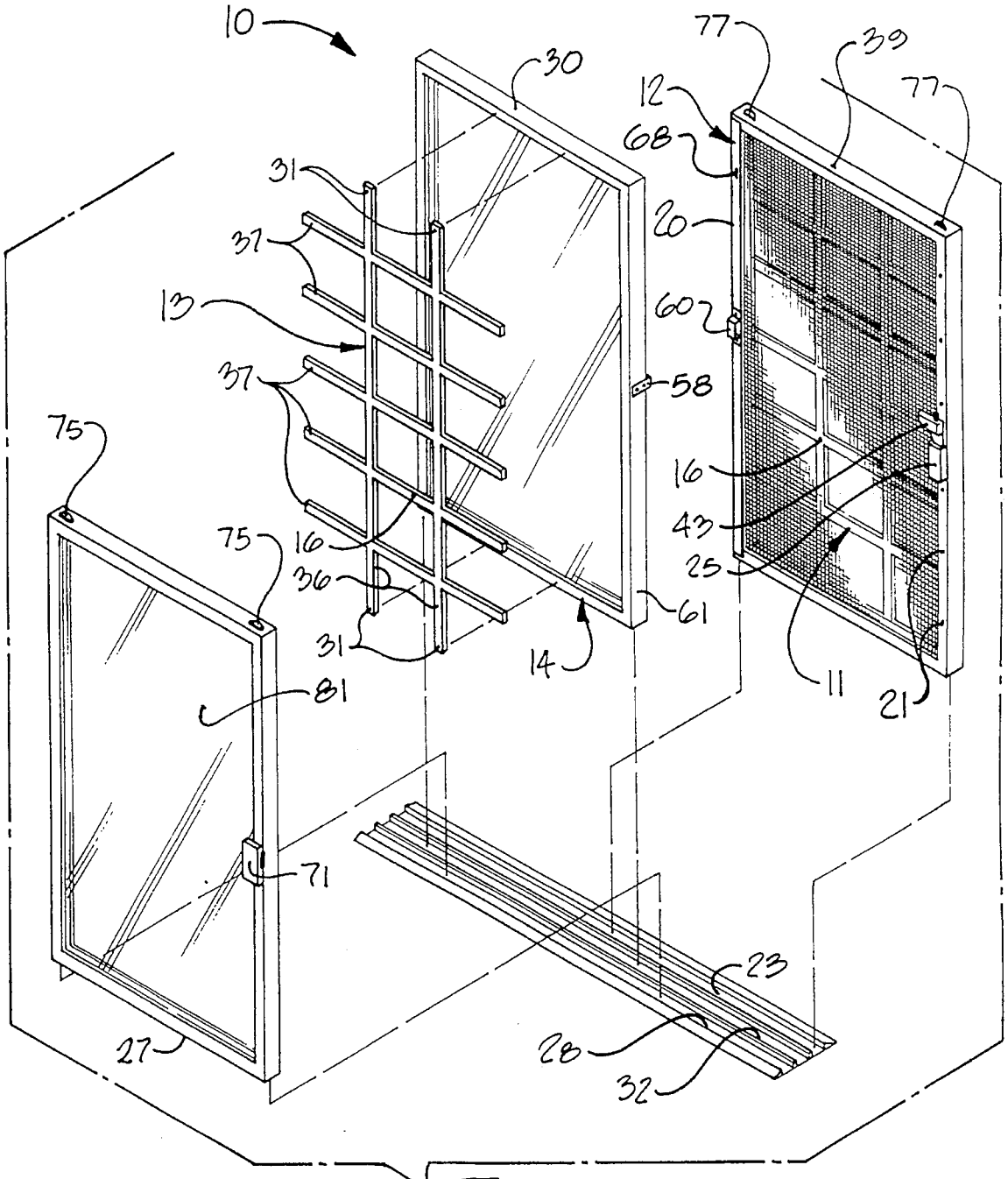
FIG. 3 is an exploded view of the components of the sliding screen door security system.
Figure 4:
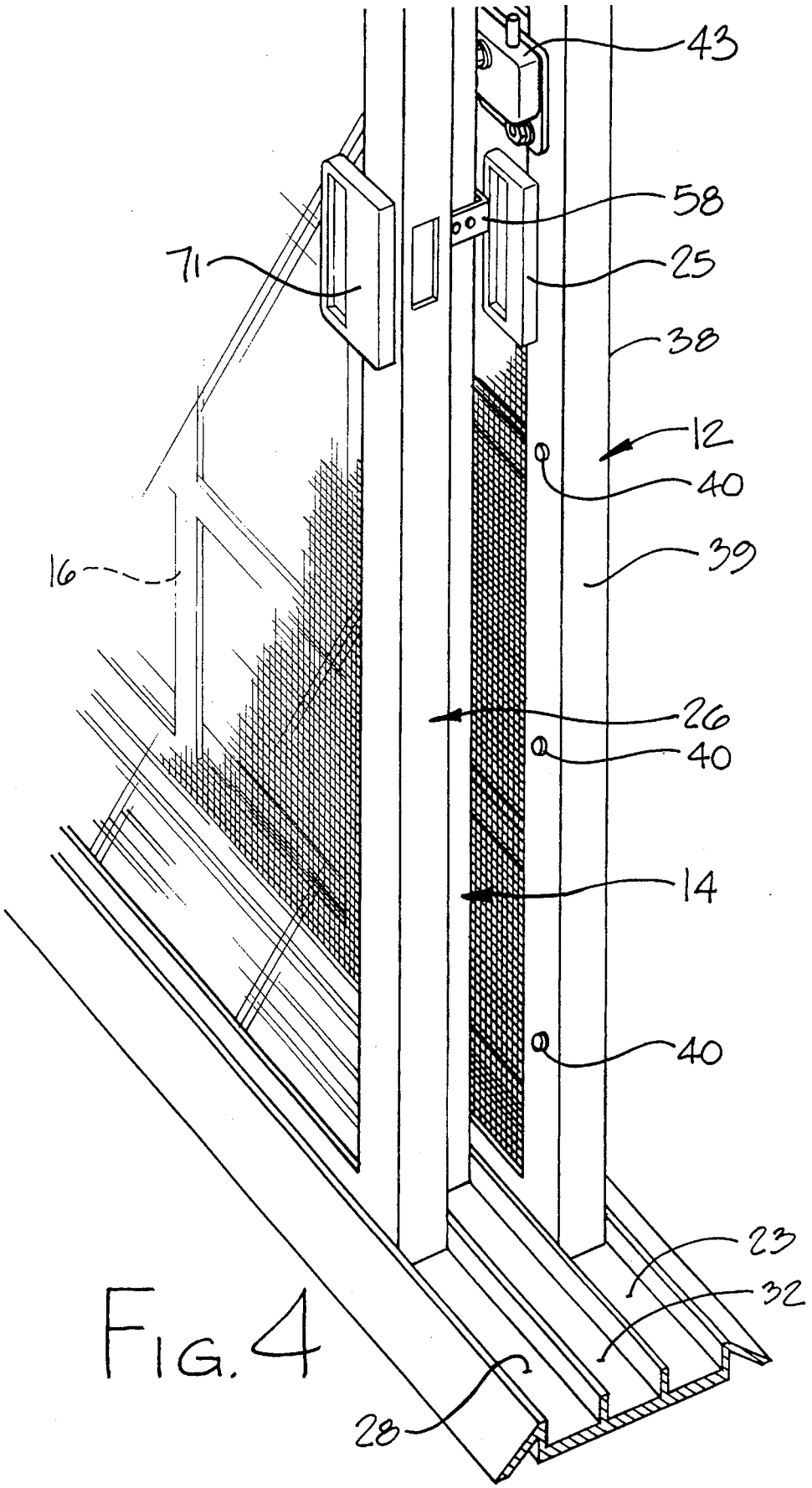
FIG. 4 is a greatly enlarged partial perspective view of the sliding screen door and sliding glass door of the security system.
Figure 5:
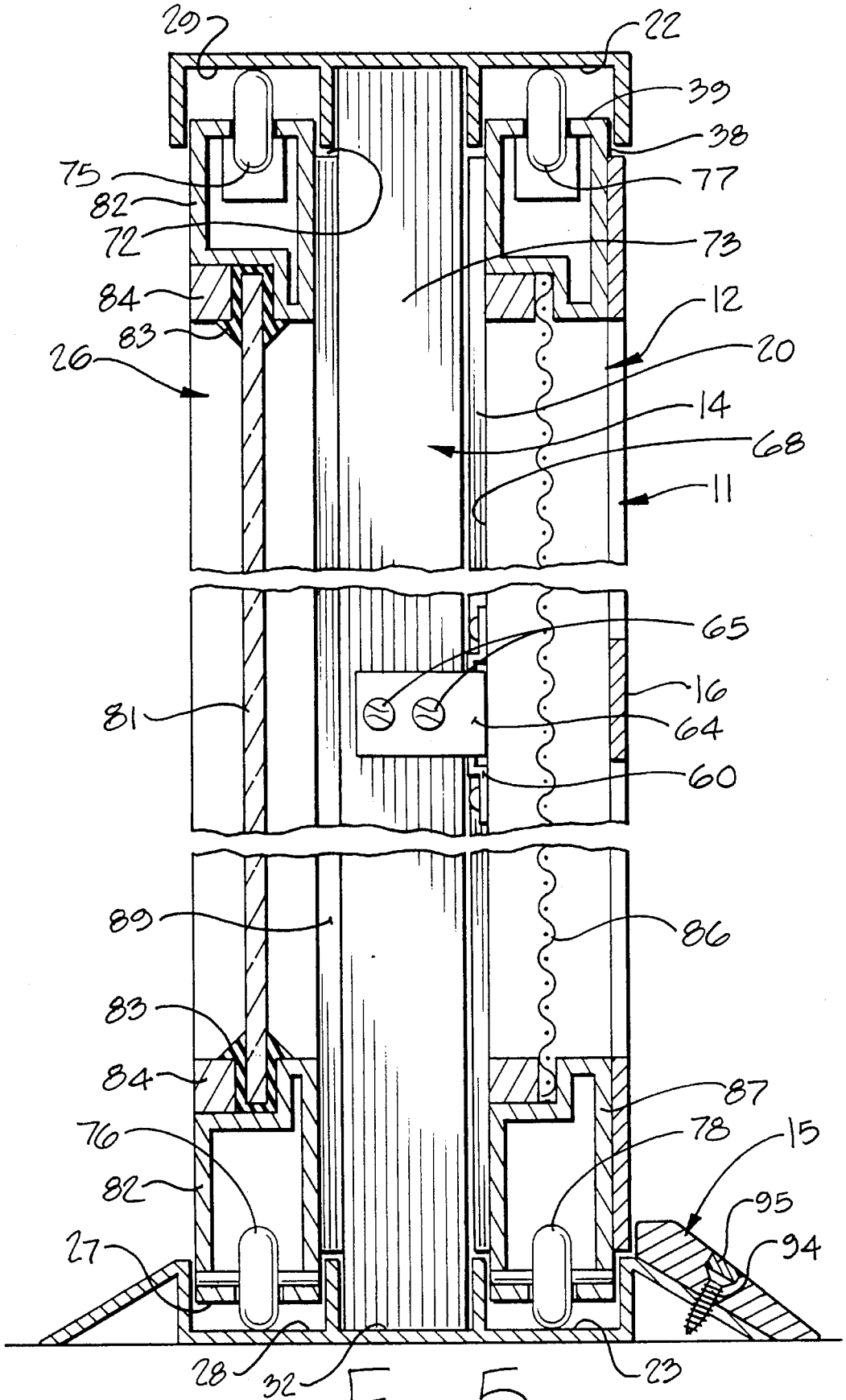
FIG. 5 is a cross-sectional view taken along lines 5—5 of FIG. 2, and drawn to an enlarged scale, such that the sliding doors and the stationary glass panel have been shortened for ease of illustration.
Figure 6:
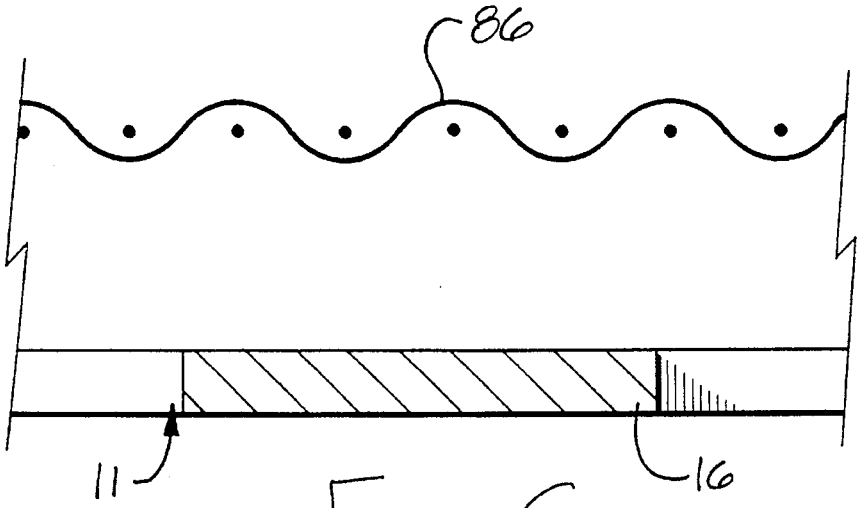
FIG. 6 is a greatly enlarged cross-section taken along lines 6—6 of FIG. 2.

Referring to FIGS. 2 to 11, the screen door 12 with its security grille 11 attached thereto slides in an upper track 22 (FIG. 5) and a lower track 23 (FIGS. 2, 3, and 5). A handle cut-out 24 at the side of the security grille 11 allows for access to the handle 25 of the sliding screen door 12. (FIG. 2)

With reference to FIG. 3, in final assembly, the bottom 27 of the sliding glass door 26 sits in its track 28. The top 30 of the glass sliding door 26 fits in an upper track 29 (FIG. 5). A security grille 13 is attached by screws (shown in FIG. 11) through holes 31 to the rear frame surface 33 of the stationery glass panel 14. The stationary glass panel 14 is fixed in the center track 32 between the sliding glass door 26 and sliding screen door 12. The sliding screen door 12 with attached security grille 11 slides in the lower outside track 23 and upper inside track 22 (FIG. 5).

The security grille 13 (FIG. 3) for the stationary glass panel 14 can be attached most conveniently with security one-way screws (shown in FIG. 11) inserted through holes 31 drilled in the vertical projecting members 36 of the security grille 13 in registry with opposite rear frame surface 33 of the stationary glass panel 14. The horizontal projecting members 37 fit into a grooved-channel (not shown) in the frame 33 of the stationary glass panel 14. As an alternative method for attaching the security grille 13, the grille 13 could be welded to the rear frame surface 33 around the edge of the stationary glass panel 14.

The security grille 11 of this invention is attached to the outside surface 38 of the frame 39 surrounding the sliding screen door 12 (FIGS. 3–5). The grille 11 is attached with one-way security bolts 21. The back of bolt 21 is shown in FIG. 3. In FIGS. 1, 2, 3, 7, 10, and 11, the screen door security grille 11 is mounted using a grille 11 with a jay-channel 20. Alternately, the grille could be welded to the front surface of the sliding door frame 39. In lieu of screws or bolts, pop-rivets could be used.

The security grille 11 for the sliding screen door 10 is provided in two major designs. One design is a flush surface mount design (not shown) and requires bolts on two vertical edges. The second design is a wrap-around design employing a jay-channel with bolts required only on one vertical edge.

The flush surface mount grille (not shown) has drilled holes along its two longitudinal vertical edges in registry with the outside frame 38 of the sliding screen door 12. The grille 11 is attached to the screen door frame 38 by bolts inserted through the drilled holes in the edge of the grille and into the frame 39 of the sliding screen door 12.

The grille 11 with the wrap-around design or jay-channel 20 (shown in detail in FIGS. 7, 10, and 11) has along a longitudinal vertical edge 41 a jay-channel, wrap-around 20 and along its opposite vertical longitudinal edge drilled holes 42 for inserting bolts 21. In FIGS. 1 and 2, the right side edge of the grille is free of bolts because the edge of the sliding screen door has been inserted into the jay-channel 20 and the left side of the door presents bolts heads 21. The bolts 21 used to secure the grille 11 are security or one-way bolts (known in the art) which are easily screwed in and not easily removed. This wrap-around edge serves several beneficial purposes. The wrap-around edge will eliminate the need to use security bolts along one edge of the security grille and thereby make installation of the grille easier. Further, the wrap-around edge lends strength to the sliding screen door.

The sliding screen door security system 10 is supplied with an elegant key-operated locking unit 43. (Shown in detail in FIGS. 8 and 9). This unit 43 is superb in that it can be placed in any position along the rear of the door frame 44 and the door jamb 45. This allows the lock 43 to be in an out-of-the-way place and thus will further deter unauthorized opening of the screen door 12.

Figure 8:
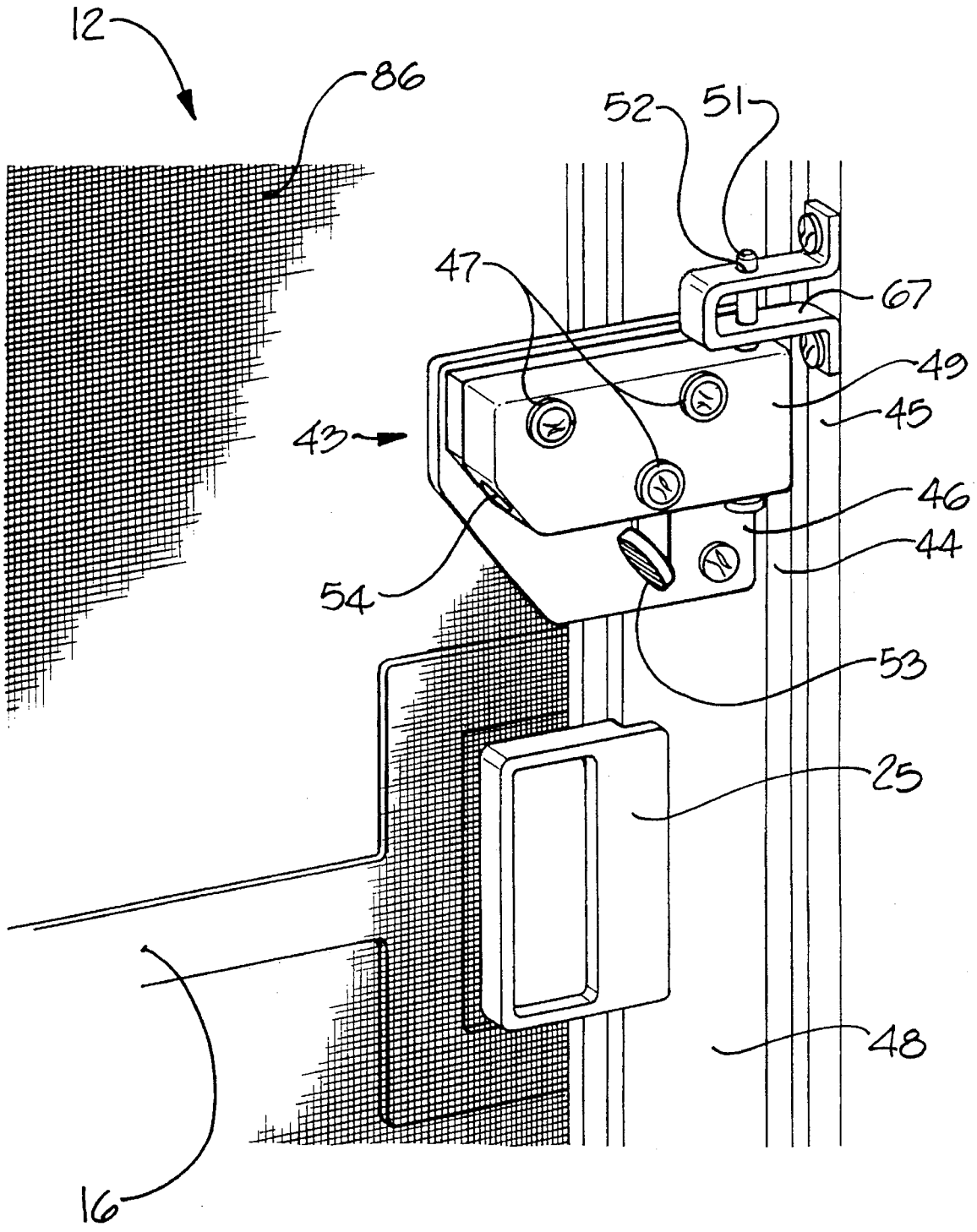
FIG. 8 is a perspective view of a key-operated lock attached to the sliding screen door. Part of the sliding screen door and door jamb have been broken away for ease of illustration.
Figure 9:
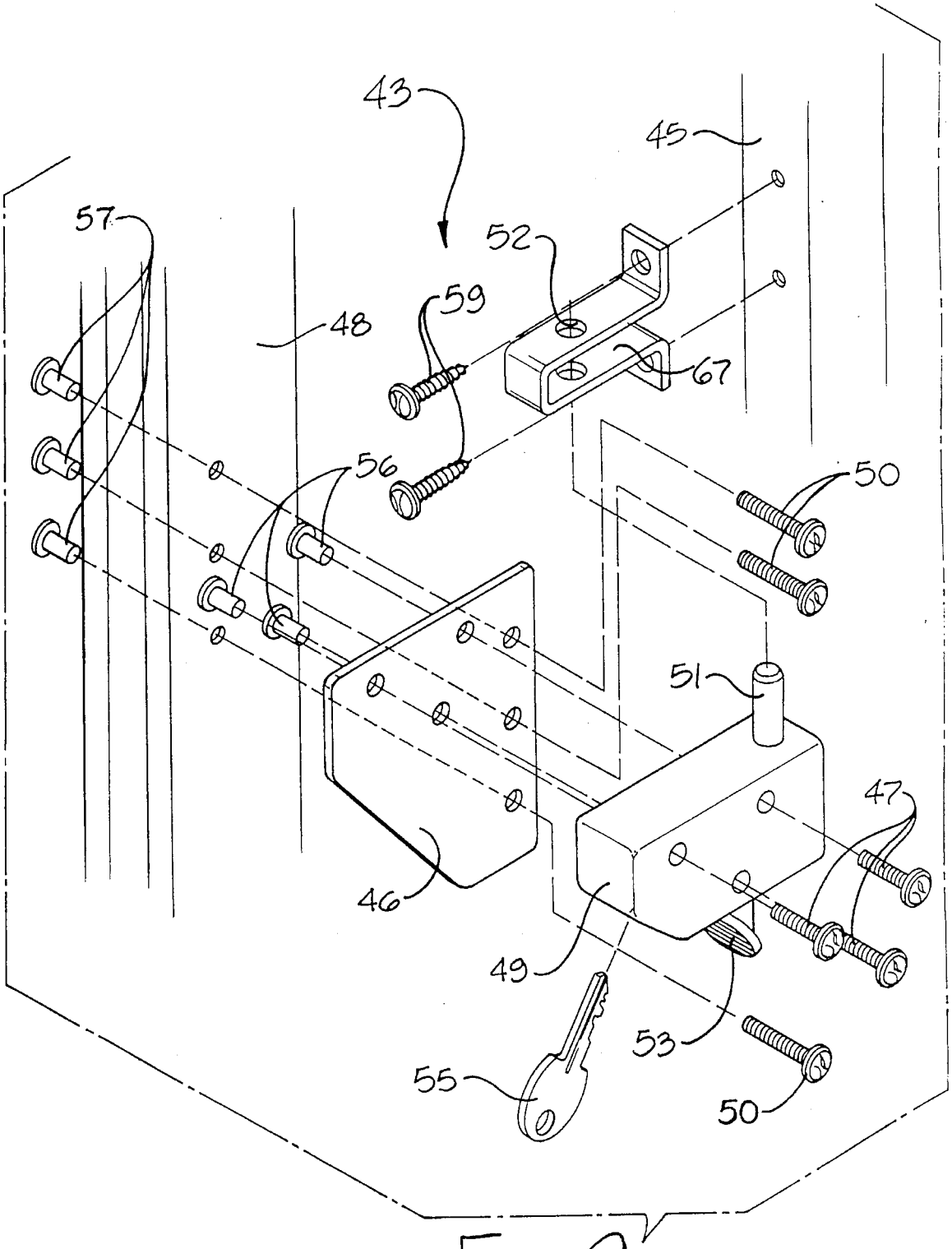
FIG. 9 is an exploded view of the key-operated lock components to be attached to the sliding screen door and door jamb.

With reference to FIGS. 8 and 9, the sliding screen door 12 with keyed or key-operated lock 49 for securing shut the sliding screen door 12 is mounted on a mounting bracket 46 which in turn is mounted on the vertical rear door or frame 48. The mounting bracket 46 is first mounted on the vertical rear frame member 48 of the sliding screen door 12 (FIG. 8) with bracket mounting barrel bolts 50, 57. The key locked main body 49 is bolted onto a mounting bracket 46 with barrel bolts 47, 56. The keyed lock 49 as shown is in the locked position (FIG. 8) with the bolt 51 inserted vertically into the keeper 52. A thumb-lever 53 is positioned under the lock 49 to manually close or open bolt 51 from its keeper 52. Once the bolt 51 is in keeper 52, the key 55 is used to secure the lock. In the figures, the unlocked position is not shown. There is a key-hole 54 only partially shown (FIG. 8) for inserting a key 55 to key-lock the sliding screen door 12.

The main components of the key-operated lock 43 (FIG. 9) are the mounting bracket 46, the keeper bracket 67 into which the lock bolt 51 is inserted, and the key lock main body 49. The mounting bracket 46 is to be mounted on the vertical rear frame 48 of the sliding screen door 12 with mounting barrel bolts 50, 57. The keeper bracket 67 is mounted on the door jamb 45 with its mounting screws 59. The key lock main body 49 is attached to the mounting bracket 46 with mounting barrel bolts 47, 56. In the figure shown, the bolts 47, 50, 56, 57 are security head barrel bolts with male and female portions. Blind head bolts or security bolts are made difficult to remove when using the conventional screw driver and are conventional in the art.

Referring to FIG. 8, note that the bolt 51 inserted vertically into the keeper 52 will prevent the sliding screen door from being opened horizontally and the relationship of the lock 49 main-body and the keeper bracket 67 will prevent the sliding screen door 12 from being lifted off of its track.

Figure 7:
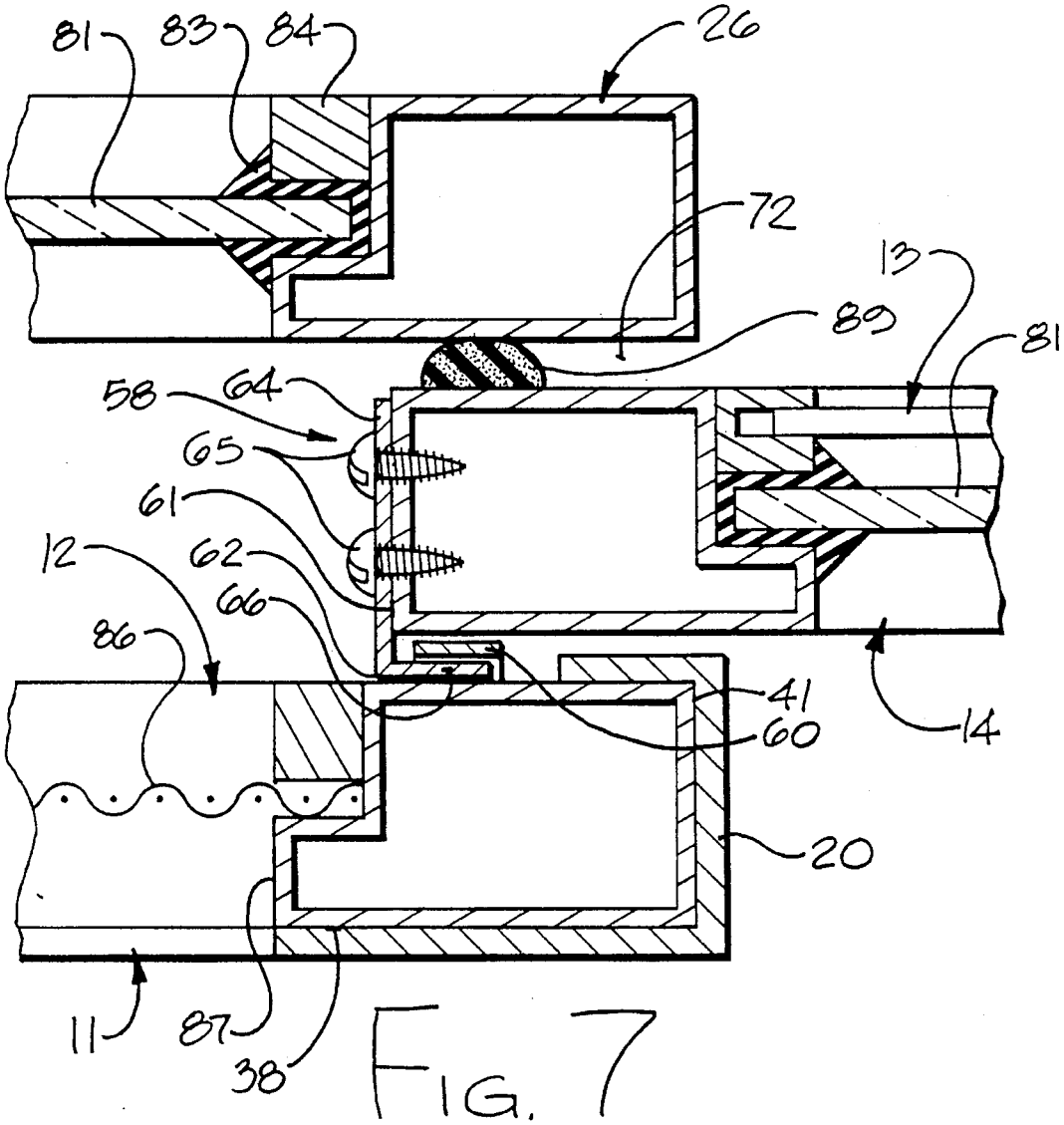
FIG. 7 is a greatly enlarged cross-section taken along lines 7—7 of FIG. 2. The sliding screen door and the sliding glass door are both shown in the closed position. The sliding screen door, the stationary glass panel and the sliding glass door are all shown broken away for ease of illustration. The bottom track and threshold have not been shown for clarity of illustration.

The sliding screen door keyed lock 43 is unique in that not only will the key-operated lock 43 provide added security in preventing the sliding screen door 12 being opened, but the unique placement of the keyed lock 43, bolt 51, and keeper bracket 67, along with the flat bolt 58 and its keeper 60 at the opposite vertical surface 61 of the sliding screen door 12, will prevent the screen door 12 from being lifted and removed from its track 23 (FIGS. 3, 5, and 7).

A security flat bolt 58 (FIG. 7) is attached to the vertical frame edge 61 of the stationary glass panel 14. The security flat bolt unit 58 has a right angle configuration 62 with one arm 64 of the right angle being attached with screws 65 to the edge of the stationary glass panel 61 and the other arm 66 of the right angle 62 serving as the security flat bolt 58. The flat bolt attachment to the stationary glass panel 14 is held in place by screws 65 through the flat bolt attachment and the frame edge 61 of the stationary glass panel 14.

The security flat bolt 58 is designed to fit into a keeper 60 (FIGS. 3 and 7) attached to vertical surface 68 of the sliding screen door 12. When the screen door 12 is closed, the flat bolt 58 engages its keeper 60. This engagement is designed to aid in preventing the unauthorized removal of the sliding screen door 12 from its track 23. The security flat bolt 58 and keeper 60 arrangement, in conjunction with the keyed lock 43 arrangement, is designed to prevent the sliding screen door 12 from being lifted vertically out of its track 23 when the sliding screen door is in the closed and locked position. The security flat bolt has been described as a flat bolt, however bolts of other configurations, such as a round bolt, would be functional.

With reference to FIG. 4, the sliding screen door 12 and the sliding glass door 26 have handles 25 and 71, respectively, for opening and closing the doors 12, 26 from inside the building. The sliding glass door 26, stationary glass panel 14, and sliding screen door 12 are set in their proper tracks 28, 32, and 23, respectively. The sliding glass door 26 and sliding screen door 12 slide in tracks 28 and 23, respectively, while the stationary glass panel 14 is in a fixed position in track 32.

There is an adequate space 72 provided between the sliding glass door track 28 and the stationary glass track to accommodate the stationary glass panel grille 13 and allow the sliding glass door 26 to move freely (FIG. 7).

FIGS. 3, 4, 5, and 7 illustrate the juxtaposition of the sliding screen door 12 with attached security grille 11, to the stationary glass panel 14 and to the sliding glass door 26; as well as the assembly of internal components making up sliding doors 12 and 26. In final assembly, the sliding glass door 26 slides in its track 28, a stationary glass panel 14 in a frame 39 is interposed between the sliding glass door 26 and sliding screen door 12 (FIG. 5). The sliding glass door 26 and sliding screen door 12 slide in their respective lower tracks 28, 23. In FIG. 5, the sliding glass door 26 and the sliding screen door 12 are both closed.

On both the sliding glass door and the sliding screen door, there are sets of rollers or wheels provided to ease the sliding of the doors in their tracks (FIG. 5). The sliding glass door 26 is provided with upper rollers 75 and lower rollers 76; the sliding screen door 12 is provided with upper rollers 77 and lower rollers 78. The upper rollers 75 and 77 are spring loaded rollers fitting into the sliding glass door upper track 29 and the sliding screen door upper track 22. Because of this spring loaded arrangement of upper wheels 75, 77, the respective doors can be forced up in the upper track and will be able to clear their lower tracks for proper insertion. The upper rollers glide in their respective tracks.

A glass pane 81 fits in its frame 82 and is held securely by a gasket 83 and a bead 84 which secures the pane 8 and gasket 83 in the frame 82 (FIGS. 5 and 7). The invention has been described in the context of single glass pane doors and panels, however, the invention would be operative with doors and panels of double pane glass.

The screen 86 of the sliding screen door 12 is held in a frame 87 (FIGS. 5 and 7). To the outside surface of this frame 87 is attached the security grille 11 of this invention. The security grille 11 is generally attached with security one-way bolts when the security grille is to be installed as a retrofit on a previously installed sliding screen door. When the security screen door is to be installed in the factory, it could be installed by welding.

Between the sliding glass door 26 and the stationary glass panel 14 there is a vertical seal or weather strip 89 to seal the space between the sliding glass door 26 and the stationary glass panel 14 when the sliding glass door is closed thus preventing unwanted air circulation (FIG. 7).

The security grille (FIG. 6) is made of metal strip stock welded together and then smoothed to form the French Door look. The grille of this invention can be made from ⅛"×¾"

flat steel strips. These steel strips are welded and smoothed to form the grids 16 of the grille. While steel is the preferred material for fabrication, other strong metals or like material can be employed. A powder coat finish will protect the grille from rust, fading, and chipping. In general, the rectangular grids of the grille could be 8½" by 13" in size.

With reference to FIG. 7, the sliding screen door 12 and glass sliding door 26 are both in a closed position. The flat bolt 58 is in its keeper 60. As previously pointed out, the bolt in the keeper will keep the sliding screen door from being lifted from its track.

The security system of this invention 10 can be supplied in a kit or package 90 (FIG. 11) for installation in existing sliding door systems. In the kit 90, there are supplied the security grille 11 for the sliding screen door 12; the grille 13 for the stationary glass panel 14; the key-operated lock unit 43 including the keeper bracket 67 and mounting bracket 46; the raised threshold 15; the security flat bolt 58 and its keeper 60 and the mounting hardware to mount the components of the security system.

Figure 11:
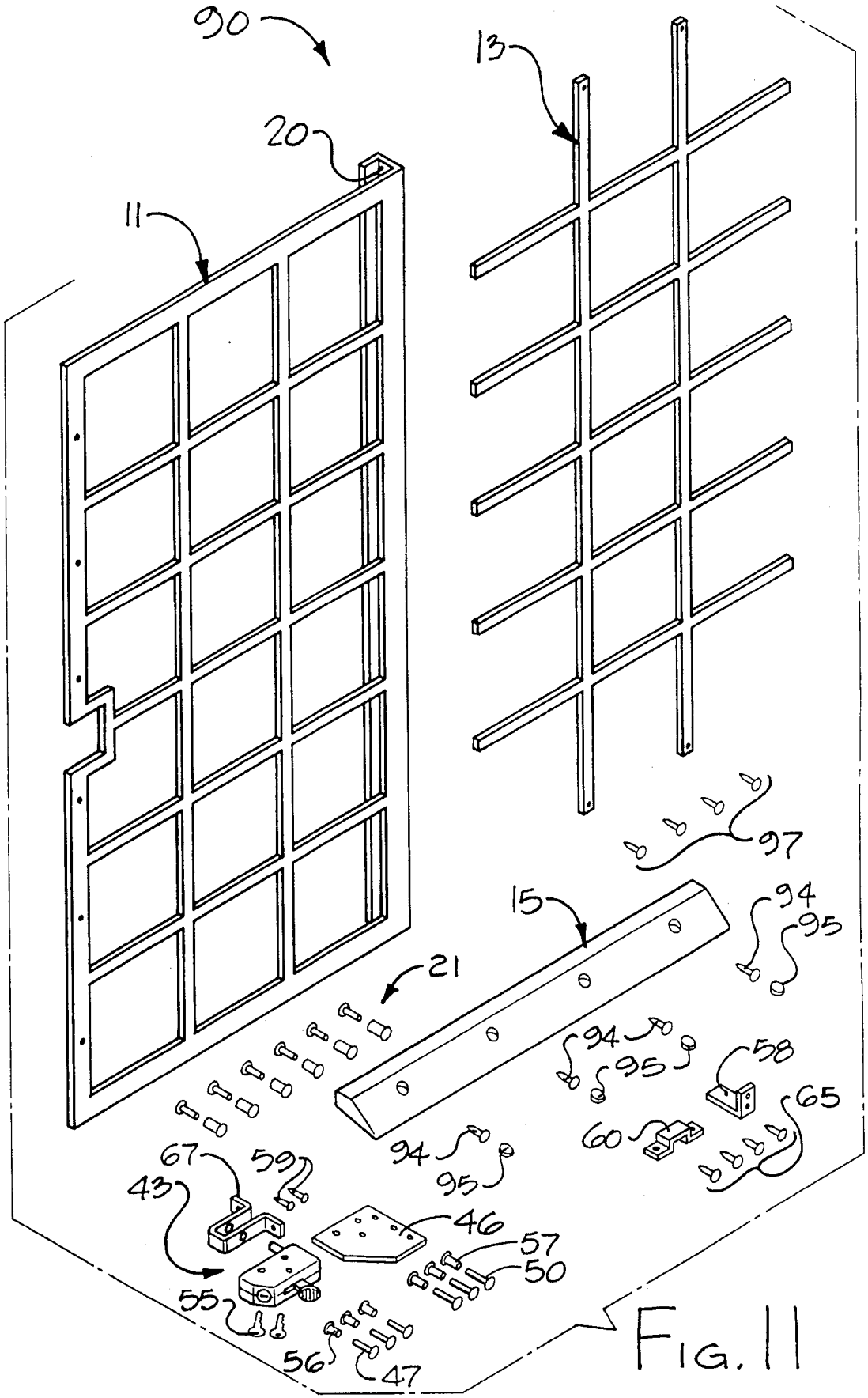
FIG. 11 is a perspective view of the parts which make up the components of the sliding screen door security system.

The mounting hardware to mount the sliding screen door security grille are one-way bolts 21, however, one-way screws or pop-rivets could be employed. The mounting hardware for the stationary glass panel security grille 13 are one-way security screws 97. Barrel bolts 50, 57 and 47, 56 are used to mount the key-operated lock assembly 43. One-way screws 94 and plug 95 are used to mount the raised threshold 15. The raised threshold could be made of wood, such as oak; or metal, such as aluminum. One-way screws 65 are used to mount the security flat bolt 58 and its keeper 60. In FIG. 11, the sliding door security grille 11 is one with a jay-channel 20, however, a flush mounted grille could alternately be supplied in the package.

The instant invention in the main has been directed to one with a single glass sliding door, however, it could be used with a double sliding door arrangement.

Figure 12:
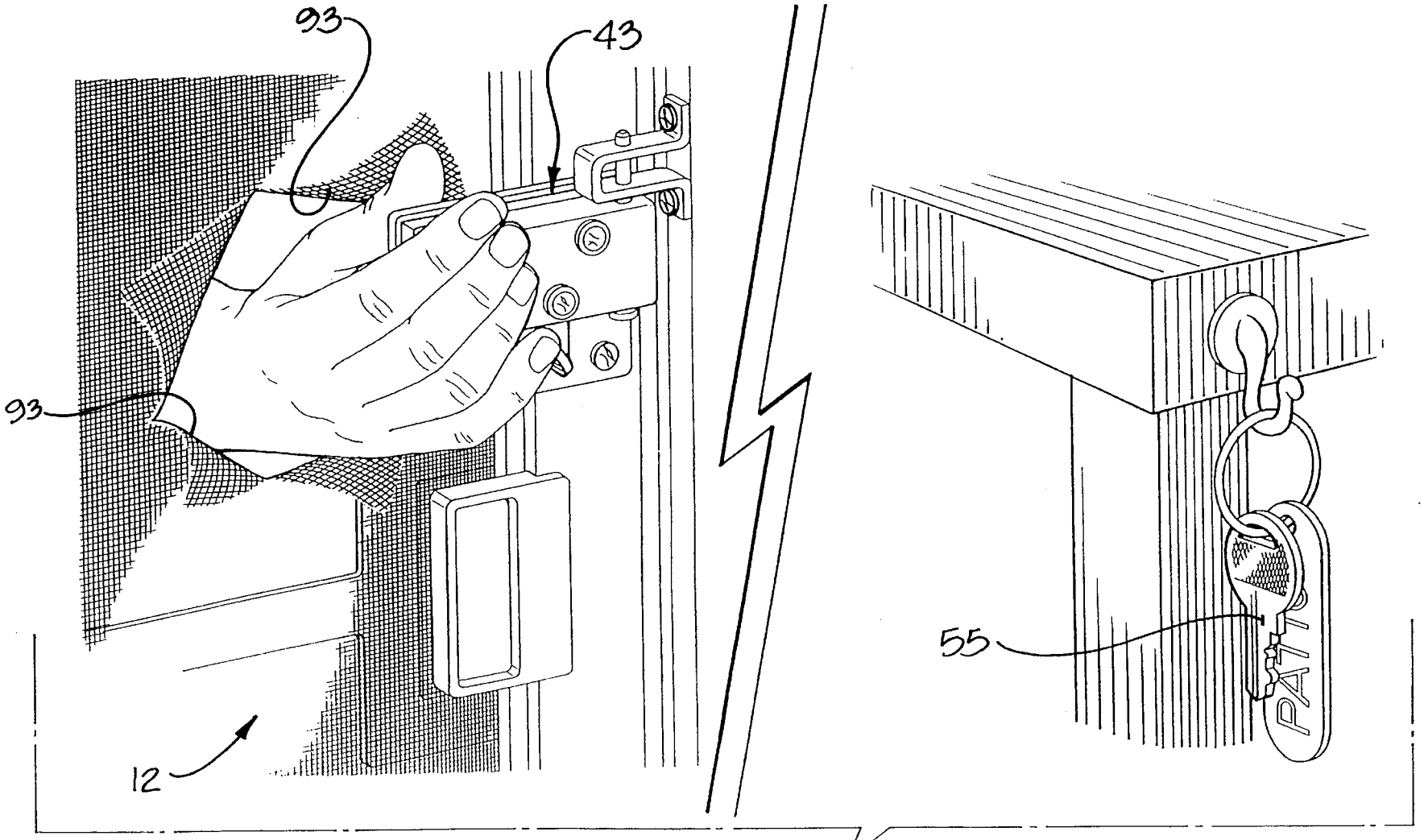
FIG. 12 depicts a view of how a burglar attempting to gain access to the home interior is frustrated. Part of the building has been abbreviated for ease of illustration.

The sliding screen door security arrangement is of great advantage in frustrating any would-be burglar (FIG. 12). A primary advantage is the fact that the key-operated lock 43 is located on the inside frame of the sliding screen door; thus, in order for any burglar to gain access to the lock 43, the burglar will find that the lock 43 is a key-operated lock; with the key 55 in a remote place in the interior of the home. (In FIG. 12, the building structure is shown abbreviated because of the distance of the key from the lock.)

There are many features of security which would frustrate any attempt by a would-be burglar to gain access to the building or house by lifting the sliding screen door from its track. Among the features are the grille per se, the unique lock unit, the sliding flat security bolt, and the raised threshold: all of which are designed to frustrate burglary.

There are many benefits to be derived from the sliding door security system of this invention.

There are substantial features of safety and protection attendant to the use of the security system of this invention. The screen door with attached grille can be securely locked with a lock which is hidden from view and not readily accessible from the outside. There are lock stops which will allow the sliding screen door to open to specified locked positions. With the sliding screen door in the locked position, the companion glass sliding door can be opened or closed on its own track to control the amount of ventilation coming through the screen. The lock arrangement for the security system is elegant in that the lock can be installed at any level on the door jamb. This feature can be employed to maximize security. A security threshold, as well as security brackets are supplied with the sliding screen door security system. These will prevent the unauthorized lifting of the sliding screen door from its track. With the security grille on both the screen door, as well as in the sliding door, there is an added measure of protection.

In areas where small children play, the security grille is of particular benefit because it offers safety from intrusion, as well as allowing for the ventilation of the room. With this ready access to ventilation, there is a saving of air conditioning expense.

The security system is aesthetically pleasing. The security grille arrangement has a complete, balanced French Door appearance because the grille is not only supplied to the sliding screen door, but is also supplied to the opposite glass door. This double grille presents a pleasing, attractive appearance to the home. The French Door look is especially pleasing in appearance. Baked powder paint on the surface of the grille is designed to give many years of service without the need to repaint. Existing vertical blinds and drapes are not interfered with by the use of the security grille.

A significant advantage of the safety grille security system is the fact that the grille can be easily surface mounted to the frame of the existing sliding screen door. This allows for easy installation without the need to modify the screen door.

The sliding door security arrangement has advantages over a hinged door arrangement in that space is saved. For example, on a patio or a deck, an externally hinged screen door when opened, because of its sweep, uses up valuable patio or deck space.

The security grille is fashioned with a wrap-around to surround the vertical edge of the screen door, thus lending additional edge-support to the screen door.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A sliding screen door security kit comprising a sliding screen door, a security grille for mounting on a sliding screen door, a key-operated locking unit for attachment to said sliding screen door capable of preventing the sliding screen door from sliding and from being lifted off of its track, a sliding flat bolt locking unit comprising a fixed flat bolt and a keeper which slidably engages said bolt, which when engaged is capable of preventing the sliding door from being lifted off of its track, and mounting hardware therefor.

2. The sliding screen door security kit of claim 1 further comprising a grille for a stationary glass panel and the mounting hardware therefor.

3. The sliding screen door security kit of claim 1 further comprising a raised security threshold and mounting hardware therefor.

4. A sliding door security system to be used in a building in combination with a static panel, a sliding screen door and a sliding glass door comprising a sliding screen door and a sliding glass door, each door sliding in an upper track and a lower threshold track, the sliding screen door having a rear surface and a front surface, as well as a rear frame border and front frame border both of which are around the perimeter of the sliding screen door; the rear surface of the sliding screen door facing the sliding glass door; said front frame border around the perimeter of said sliding screen door being provided with a surface-mounted and attached security grille, wherein the mounted and attached security grille slides along with the sliding screen door, provides security to the interior of a building, as well as allowing air to readily circulate to the interior of the building to which the sliding screen door is attached, one of said sliding glass door and said stationary panel having a flat bolt and the other of said sliding screen door and said stationary panel having a keeper for engaging said flat bolt when the sliding screen door is fully closed to prevent removal of said sliding screen door.

5. The security system for a sliding screen door of claim 4 further comprising a raised threshold blocking member parallel to the lower threshold track in which the sliding screen door slides, to block the ability to readily remove the sliding screen door from its track.

6. The security system for a sliding screen door of claim 4 further comprising a key-operated lock affixed to said rear frame border to secure the sliding screen door and attached grille into a locked position said lock being an integral unit and being capable of being placed at any location along the door jamb and rear frame border.

7. The security system for a sliding screen door of claim 4 wherein the grille is of a French or Colonial design.

8. The security system of claim 4 further comprising a second sliding door, with an upper and lower track positioned between the sliding door and sliding screen door.

9. The security system for a sliding door of claim 6 wherein a stationary glass panel in a frame with a grille attached is juxtaposed between the sliding screen door and sliding glass door and with a flat bolt arrangement attached to the frame of the sliding screen door and the frame of the stationary glass panel, and with said flat bolt arrangement and key-operated lock engaged will preclude the sliding screen door from being lifted out of its track and removed.

10. In a building having a sliding door structure for a patio or balcony, wherein the structure includes a frame, a stationary glass panel, a sliding glass door, and a sliding screen door, respectively, the improvement comprising a security grille attached to the sliding screen door and sliding therewith, a key-operated lock between the sliding screen door and the frame and accessible internally of the building, such that even if the sliding screen door with its security grille attached thereto is penetrated by an intruder, the lock cannot be unlocked by the intruder to open the sliding screen door and further the sliding glass door may be opened at any desired distance from the frame, thereby adjusting the degree of desired ventilation while assuring security for the occupants of the building, one of said sliding glass door and said stationary glass panel having a flat bolt and the other of said sliding screen door and said stationary glass panel having a keeper for engaging said flat bolt when the sliding screen door is fully closed to prevent removal of said sliding screen door.

11. The improvement of claim 10, further including a matching security grille secured to the stationary glass panel.

12. The improvement of claim 11, wherein both security grilles have a French Door design, thereby providing an aesthetically pleasing appearance as well as enhanced security.

13. In a building having a sliding door structure for a patio or balcony, wherein the structure includes a frame, a stationary glass panel, a sliding glass door, and a sliding screen door, respectively, the improvement comprising a security grille attached to the sliding screen door and sliding therewith, a key-operated lock between the sliding screen door and the frame and accessible internally of the building, in addition attached to the stationary glass panel and the sliding screen door are a stationary horizontal flat bolt and keeper, such that when the sliding screen door is closed, the stationary horizontal flat bolt will lock into its keeper and with the key-operated lock fastened the sliding screen door cannot be lifted out of its track.

14. In the sliding screen door, security grille and key-operated lock of claim 13 further characterized in that the key-operated lock has a bolt moving in a vertical orientation to be received in a keeper placed above the key-operated lock.

15. In the building structure of claim 13, wherein there is a second security grille attached to the stationary glass panel.

16. In a building having a sliding door structure for a patio or balcony, wherein the structure includes a frame, a stationary glass panel, a sliding glass door, and a sliding screen door, respectively, the improvement comprising a security system in which a security grille is attached to the inside surface of the stationary glass panel and with a second security grille attached to the outside of the sliding screen door and sliding therewith, a key-operated lock between the sliding screen door and the frame and accessible internally of the building, and attached to the stationary glass panel and the sliding glass door are a stationary horizontal bolt and keeper, such that when the sliding screen door is closed, the stationary horizontal flat bolt will lock into its keeper and with the key-operated lock fastened, the sliding screen door cannot be lifted out of its track and further even if the sliding screen door with its security grille attached thereto is penetrated by an intruder, the lock cannot be unlocked by the intruder to open the sliding screen door.

17. A building having a sliding door structure for a patio or balcony, wherein the structure includes a frame, a stationary glass panel, a sliding glass door, and a sliding screen door, respectively, the sliding doors having respective tracks and further having respective open and closed positions, the improvement comprising a security grille attached to the sliding screen door and sliding therewith, such that the sliding glass door may be opened at any desired distance from the frame while the sliding screen door is in the closed position thereof, thereby adjusting the degree of desired ventilation while assuring security for the occupants of the building, a first lock installed between the sliding screen door and the frame and accessible internally of the building, the first lock including a first bolt movable along a substantially vertical axis, thereby precluding horizontal movement of the sliding screen door from the closed position thereof, a second lock installed between the sliding screen door and the stationary glass panel, the second lock including a second bolt movable along a substantially horizontal axis with the movement of the sliding screen door and engaging a keeper on said stationary glass panel, thereby precluding a substantial vertical movement of the sliding screen door out of the respective track therefor, such the first and second locks, respectively, preclude substantial movement of the sliding screen door and the security grill attached thereto in the vertical plane thereof.

18. The improvement of claim 17, wherein the first lock comprises a key-operated lock.

* * * * *